US007645719B2

(12) United States Patent
Wehr et al.

(10) Patent No.: US 7,645,719 B2
(45) Date of Patent: Jan. 12, 2010

(54) THERMAL PAPER WITH SECURITY FEATURES

(75) Inventors: Mary Ann Wehr, Miamisburg, OH (US); Zackary D. Baggett, Jackson, TN (US); Wendell B. Halbrook, Jr., Miamsiburg, OH (US)

(73) Assignee: NCR Corporation, Dayton, OH (US)

( * ) Notice: Subject to any disclaimer, the term of this patent is extended or adjusted under 35 U.S.C. 154(b) by 301 days.

(21) Appl. No.: 10/964,047

(22) Filed: Oct. 13, 2004

(65) Prior Publication Data

US 2006/0079399 A1 Apr. 13, 2006

(51) Int. Cl.
*B41M 5/20* (2006.01)
*B41M 5/24* (2006.01)

(52) U.S. Cl. ..... 503/209; 503/200; 503/226

(58) Field of Classification Search ..... 503/200, 503/209, 226

See application file for complete search history.

(56) References Cited

U.S. PATENT DOCUMENTS

| | | | | |
|---|---|---|---|---|
| 2,800,457 | A | | 7/1957 | Green et al. |
| 3,016,308 | A | | 7/1962 | McCauley |
| 3,116,206 | A | | 12/1963 | Brynko et al. |
| 3,167,602 | A | | 1/1965 | Bentor et al. |
| 3,202,533 | A | | 8/1965 | Saschel et al. |
| 3,429,825 | A | | 2/1969 | Voedisch |
| 3,429,827 | A | | 2/1969 | Ruus |
| 3,596,275 | A | | 7/1971 | Sweet |
| 3,663,278 | A | | 5/1972 | Blose et al. |
| 4,150,997 | A | | 4/1979 | Hayes |
| 4,153,593 | A | | 5/1979 | Zabiak et al. |
| 4,269,627 | A | | 5/1981 | Hwang |
| 4,288,701 | A | | 9/1981 | Hill |
| 4,315,643 | A | | 2/1982 | Tokunaga et al. |
| 4,328,332 | A | | 5/1982 | Hayes et al. |
| 4,370,370 | A | | 1/1983 | Iwata et al. |
| 4,388,362 | A | | 6/1983 | Iwata et al. |
| 4,403,224 | A | | 9/1983 | Wirnowski |
| 4,424,245 | A | | 1/1984 | Maruta et al. |
| 4,425,161 | A | | 1/1984 | Shibahashi et al. |
| 4,444,819 | A | | 4/1984 | Marutal et al. |
| 4,452,843 | A | | 6/1984 | Kaule et al. |
| 4,507,669 | A | | 3/1985 | Sakamoto et al. |
| 4,551,738 | A | | 11/1985 | Maruta et al. |
| 4,598,205 | A | | 7/1986 | Kaule et al. |
| 4,604,635 | A | | 8/1986 | Wiklof et al. |
| 4,682,194 | A | | 7/1987 | Usami et al. |
| 4,687,701 | A | | 8/1987 | Knirsch et al. |
| 4,722,921 | A | | 2/1988 | Kiritani et al. |
| 4,740,495 | A | | 4/1988 | Marinelli et al. |
| 4,742,043 | A | | 5/1988 | Tanaka et al. |
| 4,783,493 | A | | 11/1988 | Motegi et al. |
| 4,855,277 | A | * | 8/1989 | Walter ..... 503/204 |
| 4,886,744 | A | | 12/1989 | Arnost et al. |
| 4,942,150 | A | | 7/1990 | Usami et al. |
| 5,008,238 | A | | 4/1991 | Gotoh et al. |
| 5,106,998 | A | | 4/1992 | Tanaka et al. |
| 5,155,230 | A | | 10/1992 | Hibino et al. |
| 5,158,924 | A | | 10/1992 | Konagaya et al. |
| 5,177,218 | A | | 1/1993 | Fischer et al. |
| 5,206,395 | A | | 4/1993 | Fischer et al. |
| 5,240,781 | A | | 8/1993 | Obata et al. |
| 5,250,493 | A | | 10/1993 | Ueda et al. |
| 5,266,447 | A | | 11/1993 | Takahashi et al. |
| 5,292,855 | A | | 3/1994 | Krutak et al. |
| 5,336,714 | A | | 8/1994 | Krutak et al. |
| 5,348,348 | A | | 9/1994 | Hanada et al. |
| 5,384,077 | A | | 1/1995 | Knowles |
| 5,393,469 | A | * | 2/1995 | Akhavan-Tafti ..... 252/700 |
| 5,397,819 | A | | 3/1995 | Krutak et al. |
| 5,405,958 | A | | 4/1995 | VanGemert |
| 5,407,885 | A | | 4/1995 | Fischer et al. |
| 5,423,432 | A | | 6/1995 | Krutak et al. |
| 5,426,143 | A | | 6/1995 | de Wit et al. |
| 5,427,414 | A | | 6/1995 | Fletcher et al. |
| 5,427,415 | A | | 6/1995 | Chang |
| 5,429,774 | A | | 7/1995 | Kumar |
| 5,446,151 | A | | 8/1995 | Rickwood et al. |
| 5,461,136 | A | | 10/1995 | Krutak et al. |
| 5,468,581 | A | | 11/1995 | Coe et al. |
| 5,480,482 | A | | 1/1996 | Novinson |
| 5,500,040 | A | | 3/1996 | Fujinami |
| 5,503,904 | A | | 4/1996 | Yoshinaga et al. |
| 5,548,003 | A | | 8/1996 | Remar et al. |
| 5,558,020 | A | | 9/1996 | Marozzi et al. |

(Continued)

FOREIGN PATENT DOCUMENTS

| | | |
|---|---|---|
| EP | 0327788 | 8/1989 |

(Continued)

OTHER PUBLICATIONS

US 5,368,348, 11/1994, Christy et al. (withdrawn)

*Primary Examiner*—Bruce H Hess
*Assistant Examiner*—David J Joy

(57) ABSTRACT

A thermal paper with a fluorescent security mark printed on the thermosensitive coating that is responsive to wavelengths in the range of 200 nanometers to 400 nanometers. The mark is either printed on the thermosensitive coating directly or on an optional protective top coat positioned over the thermosensitive coating. Methods of preparing the thermal paper comprise printing a solution, dispersion or emulsion of a fluorescent compound on the thermal paper by flexographic printing.

11 Claims, No Drawings

U.S. PATENT DOCUMENTS

| | | | | |
|---|---|---|---|---|
| 5,583,223 | A | 12/1996 | Fischer et al. | |
| 5,584,077 | A | 12/1996 | Thrift | |
| 5,595,955 | A | 1/1997 | Chang et al. | |
| 5,601,929 | A | 2/1997 | Sideman | |
| 5,614,008 | A | 3/1997 | Escano et al. | |
| 5,665,151 | A | 9/1997 | Escano et al. | |
| 5,682,103 | A | 10/1997 | Burrell | |
| 5,690,857 | A | 11/1997 | Osterried et al. | |
| 5,703,229 | A | 12/1997 | Krutak et al. | |
| 5,728,832 | A | 3/1998 | Wariishi | |
| 5,741,592 | A | 4/1998 | Lewis et al. | |
| 5,824,721 | A | 10/1998 | Sideman et al. | |
| 5,826,915 | A | 10/1998 | Gregory, Jr. | |
| 5,843,864 | A | 12/1998 | Popp et al. | |
| 5,883,043 | A | 3/1999 | Halbrook, Jr. et al. | |
| 5,912,205 | A | 6/1999 | Lakes et al. | |
| 6,048,347 | A | 4/2000 | Erdman | |
| 6,060,426 | A | 5/2000 | Tan et al. | |
| 6,060,428 | A | 5/2000 | Chang et al. | |
| 6,106,910 | A | 8/2000 | Tan et al. | |
| 6,165,937 | A | 12/2000 | Puckett et al. | |
| 6,245,711 | B1 | 6/2001 | Halbrook, Jr. | |
| 6,395,459 | B1 * | 5/2002 | Taylor et al. | 430/434 |
| 6,562,755 | B1 | 5/2003 | Halbrook, Jr. et al. | |
| 6,613,403 | B2 | 9/2003 | Tan et al. | |
| 2002/0177828 | A1 * | 11/2002 | Batich et al. | 604/367 |
| 2003/0119669 | A1 * | 6/2003 | Halbrook, Jr. et al. | 503/200 |

FOREIGN PATENT DOCUMENTS

| | | |
|---|---|---|
| EP | 0816116 | 1/1998 |
| EP | 0933228 | 8/1999 |
| GB | 920144 | 3/1963 |
| GB | 2272861 | 6/1994 |
| JP | 63074053 | 4/1988 |
| JP | 06092074 | 4/1994 |
| WO | WO 97/32733 | 8/1997 |

* cited by examiner

THERMAL PAPER WITH SECURITY FEATURES

FIELD OF THE INVENTION

The present invention relates to thermal papers which have a security feature to thwart counterfeiting.

BACKGROUND OF THE INVENTION

Thermal paper comprises a base sheet and a thermosensitive coating with color forming chemicals therein such that when heat is applied to the paper by a thermal print head, the color forming chemicals react to develop color. The application of heat is controlled to form the desired print or image.

The most common thermosensitive coatings employ a dye-developing type color forming system. There are three main color producing components in a dye developing-type thermosensitive coating and they are: a colorless dye (color former), a bisphenol or acidic material (color developer) and a sensitizer. Images are formed in the thermosensitive coating by the application of heat to melt and interact these three color producing materials.

Certain chemical factors can adversely affect and degrade the performance of the thermosensitive coating on thermal paper. These chemical factors include certain organic solvents (ketones), plasticizers (polyethylene glycol type) amines (ammonia) and oils (soy oil).

Simply handling thermal papers with certain color forming compounds can result in premature coloration unless a barrier layer or protective top coating is coated over the thermosensitive coating, (See U.S. Pat. Nos. 4,370,370; 4,388,362; 4,424,245; 4,444,819; 4,507,669; 4,551,738 and 4,604,635) or the color forming compounds are encapsulated in microcapsules which release their contents when exposed to heat, (See U.S. Pat. Nos. 4,682,194; 4,722,921; 4,740,495; 4,742,043; 4,783,493; and 4,942,150).

There are many security inks available which serve to thwart the duplication of printed commercial documents by providing latent images or images that change color when exposed to a light source other than ambient light. Fluorescent inks are one example. Conventional fluorescent inks typically contain a fluorescent compound which responds to infrared or ultraviolet light. An example of a printing ink which fluoresces under ultraviolet radiation is described in U.S. Pat. No. 4,153,593. The dyes described in this reference include fluorescein dyes, eosine dyes and Rhodamine dyes. Other ink formulations are disclosed in U.S. Pat. No. 4,328,332, issued to Hayes et al.; U.S. Pat. No. 4,150,997, issued to Hayes; U.S. Pat. Nos. 4,452,843 and 4,598,205 issued to Kaule et al., and U.S. Pat. No. 5,503,904, issued to Yoshinaga et al.

The use of conventional fluorescent inks on thermal papers has resulted in pre-reaction of the reactive components within the thermosensitive coating of the thermal paper or disruption of the color forming reaction when heated. The conventional protective top coatings and microcapsules mentioned above have not been effective in preventing premature coloration of the thermosensitive coating or disruption of the color forming reaction when exposed to conventional fluorescent security inks. As a result, special measures have been taken to incorporate security features in thermal papers. U.S. Pat. Nos. 5,883,043; 6,245,711 and 6,562,755 disclose thermal papers with security inks printed on the side opposite the thermosensitive coating and in U.S. Pat. Nos. 6,060,426; 6,106,910; 6,165,937; and 6,613,403, special near infrared fluorescent (NIRF) compounds are employed as a security feature or sense mark for thermal papers. The NIRF compounds are fluorescent compounds which respond to wavelengths in the range of 650 nm to 2500 nm and are very sensitive and unstable. Amounts as low as 0.1 ppm solids can be detected, permitting the NIRF compounds to be incorporated in the base sheet, a base coating, the thermosensitive coating or an optional top coating, with minimal interaction with the color forming compounds in the thermosensitive layer.

It is desirable to provide a thermal paper with a fluorescent security mark printed over the thermosensitive coating using a stable fluorescent compound.

SUMMARY OF THE INVENTION

The present invention provides thermal papers such as those used for cash register receipts and ATM receipts, with a thermosensitive coating on one surface and at least one fluorescent security mark printed over the thermosensitive coating. The fluorescent security mark is derived from a solution, dispersion or emulsion of a fluorescent compound which comprises a fluorescent compound and an aqueous carrier, each of which does not react or solubilize the color forming compounds in the thermosensitive coating such that the thermal paper does not discolor and will still generate color when exposed to heat. The fluorescent security mark can be printed on the thermosensitive coating or on a protective top coating positioned over the thermosensitive coating.

This fluorescent security mark can provide two modes of security, one through the variable light absorption/transmission properties provided by fluorescent compounds therein when activated and the other through the appearance of the fluorescent security mark as a pseudo water mark under ambient conditions.

The fluorescent security mark contains a fluorescent compound and either is a) free of color, i.e., transparent, or b) colored under ambient conditions by other colorants or the ambient color of the fluorescent compound. The color of the fluorescent security mark under ambient conditions changes when the mark is exposed to wavelengths at least within in the range of 200 to 400 nanometers. Color changes may be experienced when exposed to wavelengths outside this range but limiting the response to these wavelengths is preferred. Suitable fluorescent compounds include those which will produce light at wavelengths in the range 500-600 nanometers when exposed to wavelengths in the range of 200-400 nanometers.

In a further aspect of the present invention, there is provided a method of preparing thermal papers having one thermosensitive coating with a fluorescent security mark printed over the thermosensitive coating by a printing process which does not require temperatures above 50°-65° C., such as a flexographic printing process.

The methods of this invention employing a flexographic process can be performed in conventional flexographic equipment such as that described in U.S. Pat. No. 5,558,020 and those provided by Wolverine and Mark Andy (Flexopress).

The thermal papers of the present invention have a base sheet with one surface coated with a thermosensitive coating. Preferably, the base sheet is surface coated with a conventional base coating followed by the thermosensitive coating. The base coating, when used, is typically comprised of inert clays and provides a smooth surface for the thermosensitive coating. This thermosensitive coating preferably includes a dye-developing type color forming system. Particularly suitable dye developer type systems are those wherein the reactive dyes are colorless or white-colored and become dark colored when melted and exposed to a color developer. Such dyes are typically basic substances which become colored when oxidized by acidic compounds or bisphenol compounds. In these dye-developer systems, sensitizers are typically mixed with the dyes to form a blend with a reduced melting point. This reduces the amount of heat necessary to melt the dye and obtain reaction with the color developer. The components of the thermosensitive coating are often determined by the operating temperature of the thermal printer to be used. The operating temperature of conventional thermal printers varies widely, typically within the range of from 50° C. to 250° C. One skilled in the art can readily determine the melting point necessary for a desired application and select a dye and developer accordingly, or select a conventional thermal paper with a thermosensitive coating on one side. A well known dye is that identified as ODB-II with the sensitizer M-terphenyl. A preferred color developer is bisphenol A.

Color forming dyes suitable for use in the thermal papers of this invention are leuco dyes. Leuco dyes are colorless or light colored basic substances, which become colored when oxidized by acidic substances.

Examples of leuco dyes that can be used herein are described as follows:

a) Leuco bases of triphenylmethane dyes represented by formula I in column 4 of U.S. Pat. No. 5,883,043. Specific examples of such dyes are: 3,3-bis(p-dimethylaminophenyl)-phthalide, 3,3-bis(p-dimethylaminophenyl)-6-dimethylaminophthalide (Crystal Violet Lactone), 3,3-bis(p-dimethylaminophenyl)-6-diethylaminophthalide, 3,3-bis(p-dimethylaminophenyl)-6-chlorophthalide, and 3,3-bis(p-dibutylaminophenyl)-phthalide.

b) Leuco bases of fluoran dyes represented by formula II at column 5 of U.S. Pat. No. 5,883,043. Some examples are: 3-cyclohexylamino-6-chlorofluoran, 3-(N-N-diethylamino)-5-methyl-7-(N,N-Dibenzylamino)fluoran, 3-dimethylamino-5,7-dimethylfluoran and 3-diethylamino-7-methylfluoran. Other suitable fluoran dyes include: 3-diethylamino-6-methyl-7-chlorofluoran, 3-pyrrolidino-6-methyl-7-anilinofluoran, and 2-[3,6-bis(diethylamino)-9-(0-chloroanilino)xanthybenzoic acid lactam].

c) Lactone compounds represented by formula III at column 5 of U.S. Pat. No. 5,883,043. Specific examples are: 3-(2'-hydroxy-4'-dimethylaminophenyl)-3-(2'[-methoxy-5'-chlorophenyl)phthalide, 3-(2'-hydroxy-4'-dimethylaminophenyl)-3-(2'-methoxy-5'-nitrophenyl-phthalide, 3-(2'-hydroxy-4'-diethylaminophenyl)-3-(2'-methoxy-5'-methylphenyl)phthalide, and 3-(2'-methoxy-4'-dimethylaminophenyl)-3-(2'-hydroxy-4'-chloro-5'-methylphenyl)-phthalide.

There are many substances which change the color of the dyes by oxidizing them and function as developers. Color developers suitable for the thermal papers of this invention are phenol compounds, organic acids or metal salts thereof and hydroxybenzoic acid esters.

Preferred color developers are phenol compounds and organic acids which melt at about 50° C. to 250° C. and are sparingly soluble in water. Examples of phenol compounds include 4,4'-isopropylene-diphenol (bisphenol A), p-tert-butylphenol, 2-4-dinitrophenol, 3,4-dichlorophenol, 2,2-bis(4'-hydroxyphenyl)-n-heptane p-phenylphenol, 4,4-cyclohexylidenediphenol. Useful examples of organic acid and metal salts thereof include 3-tert-butylsalicylic acid, 3,5-tert-butylsalicylic acid, 5-a-methylbenzylsalicylic acid and salts thereof of zinc, lead, aluminum, magnesium or nickel.

Sensitizers or thermosensitivity promoter agents are used in the coating formulation and thermal papers of the present invention to give a good color density. The exact mechanism by which the sensitizer helps in the color forming reaction is not well known. It is generally believed that the sensitizer forms a eutectic compound with one or both of the color forming compounds. This brings down the melting point of these compounds and thus helps the color forming reaction take place at a considerably lower temperature. Some of the common sensitizers which are suitable are fatty acid amide compounds such as acetamide, stearic acid amide, linolenic acid amide, lauric acid amide, myristic acid amide, methylol compounds or the above mentioned fatty acid amides such as methylenebis (stearamide), and ethylenebis (stearamide), and compounds of p-hydroxybenzoic acid esters such as methyl p-hydroxybenzoate, n-propyl p-hydroxybenzoate, isopropyl p-hydroxybenzoate, benzyl p-hydroxybenzoate.

The thermosensitive coating compositions can be applied to any conventional base sheet suitable for use in thermal paper or base sheet coated with a conventional base layer. The base sheet must not contain any reactive elements that would prematurely color the thermosensitive coating.

The thermosensitive coating can vary in composition, as is conventionally known in the art, including the encapsulation of components therein to prevent premature coloration during handling. The thermosensitive coating can also be coated with a protective top coating, as is conventionally known in the art, to prevent premature coloration during handling. Such thermosensitive coatings and top coatings can be applied by conventional methods using conventional equipment.

The thermal papers of this invention have a fluorescent security mark printed directly on the thermosensitive coating or on an optional protective top coating. This fluorescent security mark is applied without pre-reacting the color forming compounds in the thermosensitive coating or disrupting the color forming reaction of these compounds. The fluorescent security mark comprises a fluorescent compound which responds to ultraviolet light radiation at wavelengths in the range of 200 nm to 400 nm. The density of the fluorescent compound within the fluorescent security mark (milligrams per square inch surface area) is sufficient to be sensed by a photon detector and is preferably also sufficient to be detected by the naked human eye.

The solution, dispersion or emulsion of fluorescent compounds comprises an aqueous carrier so as not to pre-activate or solubilize the color forming compounds in the thermosensitive coating.

The aqueous carrier for the fluorescent compound preferably comprises water and an ammonium compound or a similar base, preferably in an amount of 10 weight percent or less, most preferably less than 5 weight percent, based on the total weight of the aqueous carrier.

Suitable ammonium compounds provide a pH of above 7, preferably above 7 to less than 10 and most preferably, 7 to 8 at concentrations of 10 wt % or less, based on the total weight of the aqueous carrier.

Suitable ammonium compounds are those commonly used to stabilize the viscosity of the inks during flexographic printing operations. These ammonium compounds can be found in ink extenders used in flexographic printing operations to reduce the viscosity of the flexographic ink. In the absence of these stabilizers within the extenders, the viscosity of the flexographic ink increases more rapidly during flexographic printing operations.

The ammonium compounds which are preferred will maintain the viscosity of the solution, dispersion or emulsion of fluorescent compound within the range required for the flexopress to be used during flexographic printing operations when at a preferred concentration of less than 10 weight percent, based on the total weight of the solution, dispersion or emulsion of fluorescent compound. Preferred viscosity values fall within the range of about 5 to 100 cps at 25° C. and most preferably 12-25 cps at 25° C. Preferably, such stability is provided with an amount of ammonium compound of less than 5 weight percent, based on the total weight of the solution, dispersion or emulsion of fluorescent compound.

The ammonium compounds which meet the parameters above with respect to pH and viscosity stabilization at the concentrations specified have been found not to pre-react the color forming compounds or block the color forming reaction in the thermosensitive coating.

The aqueous carrier preferably also comprises a pH buffer to stabilize the pH during flexographic printing. The pH buffer must be a) sufficiently compatible so as not to cloud the aqueous carrier and b) not pre-react the color forming compounds or block the color forming reaction of the color forming compounds in the thermosensitive coating. These can be found within the conventional buffers known in the art.

The aqueous carrier may optionally have a pigment which renders the security mark white or colored. Pigments which provide a white color are preferred for security marks.

The preferred ammonium compound is ammonium hydroxide. Others include quaternary ammonium compounds such as Benzalkonium Chloride
Benzethonium Chloride
Cetalkonium Chloride
Cetrimide
Cetrimonium Bromide
Cetylpyridinium Chloride
Glycidyl Trimethyl Ammonium Chloride, and
Stearalkonium Chloride Although not preferred, organic solvents can be used in the aqueous carrier to help solubilize, disperse or emulsify the fluorescent compound or other components in the aqueous carrier, provided the organic solvents do not activate or interfere with color forming compounds of the thermal paper. An organic solvent can be tested for suitability by simply applying one or more drops on the thermosensitive coating to be used at the intended press temperature. The amount of organic solvent is preferably maintained below 1 wt. %, based on the weight of the total solution, dispersion or emulsion of fluorescent compounds.

The solution, dispersion or emulsion of fluorescent compounds is dried on the thermal paper by the evaporation of the water and any other volatile components within the aqueous carrier to deposit the fluorescent compounds and any other solids. The amount of carrier (water) used can vary from 75 to 96 wt. % based on the total weight of the solution, dispersion or emulsion containing the fluorescent compounds.

In addition to maintaining the thermosensitive components unreacted, the carrier employed must also provide a solution, dispersion or emulsion with a viscosity suitable for printing, preferably flexographic printing. As mentioned above, preferred viscosity values fall within the range of about 5 to 100 cps at 25° C. and most preferably fall within the range of 12-25 cps at 25° C. Where the solution, dispersion or emulsion of fluorescent compounds has a viscosity much higher than 50 cps at 25° C., it is diluted with water or an ink extender with ammonium compounds to maintain a desired pH.

The solution, dispersion or emulsion of fluorescent compounds used may contain additional additives to aid the performance of the fluorescent compound. A suitable additive is a soluble fluorescent brightener component that is used in combination with the fluorescent dye materials. The brightener typically enhances the fluorescence available from the same concentration of dye. Fluorescence can be increased by as much as five times the original value with the use of a fluorescent brightener. Care should be exercised to avoid the use of a brightener having an absorption curve which interferes with the fluorescence of the fluorescent material. Examples of brighteners include Calcofluor ABT by Cyanamid, Calcofluor A2RT by Cyanamid, Blancophor SV by GAF, Tinopal GS by Geigy, Leucophon BSW by Sandoz, Paper White SP by DuPont and Paper White BP by DuPont.

Conventional fillers, defoaming agents, viscosity modifiers/flow adjusters, leveling agents or cob-webbing preventative agents may also be incorporated to improve the properties of the aqueous carrier in forming a fluorescent security mark if they are inert. Illustrative examples of flow adjusters are low molecular weight organopolysiloxanes such as methylpolysiloxanes which may be used in an amount of 0.01-10 wt. % based on the weight of the total formulation. An illustrative example of a defoamer, i.e., surfactant, is Anti-Musal JIC, which may be used in an amount of 0.01-10 wt. % based on the weight of the total formulation. Illustrative examples of leveling agents are low molecular weight polysiloxane/polyether copolymers and modified organic polysiloxane, which may be used in an amount of 0.01-10 wt. % based on the weight of the total ink formulations. An illustrative example of a viscosity modifier is butylcarbitol, which can be used in an amount from 0.01-10 wt % based on the weight of the total formulation.

The solution, dispersion or emulsion of fluorescent compounds may contain an optional coloring agent. Such coloring agents are not necessary to provide a security feature and are not preferred for some applications, such as where the colors interfere with a pseudo watermark. The coloring agent is typically a dye or pigment including a variety of organic and inorganic coloring pigments and dyes. Examples include carbon blacks, and other pigments such as cadmium, primrose, chrome yellow, ultra marine blue, iron oxide, zinc oxide, titanium oxide, cobalt oxide, nickel oxide, etc. Other examples of coloring agents include those described in U.S. Pat. No. 3,663,278 and U.S. Pat. No. 4,923,749. The total amount of coloring agent is typically from about 0.01-10 wt. % of the total ink formulation. In some embodiments, the fluorescent compound selected may have a color under ambient conditions.

The above components can be mixed and dispersed uniformly by an appropriate means such as a simple impeller within a vessel or a roll mill to obtain the solution, dispersion, emulsion used to form the fluorescent security mark.

The fluorescent compound preferably does not absorb or transmit light under ambient indoor lighting conditions, i.e., is transparent or invisible to the naked human eye under such conditions but does absorb or transmit light when exposed to radiation with a wavelength in the range of 200 nanometers to 400 nanometers. Fluorescent compounds which are colored under ambient conditions are not excluded by this invention. The fluorescent compounds employed must be soluble, dispersible or emulsifiable in aqueous media, and must not pre-react the color forming compounds or otherwise disrupt the color forming reaction within the thermosensitive coating when applied as part of an aqueous medium. Suitable fluorescent compounds include the fluorescent resins produced in U.S. Pat. No. 4,328,332, from trimellitic anhydrides and propylene glycol with a zinc acetate catalyst, which respond to UV light in the range of 200 nanometers to 400 nanometers. Representative of other suitable fluorescent compounds are water soluble, dispersible or emulsifiable fluorescein and eosine dyes which respond to UV light in the range of 200 nanometers to 400 nanometers. The fluorescent compound can be in the form of pigment particles or other solids In certain embodiments, the latent image will also provide a pseudo-water mark on the paper when the ink is dried on the substrate. This mark can be generated by a solution, dispersion or emulsion of the fluorescent compound which changes the surface characteristics of the thermal paper, e.g., porosity, and contains a fluorescent compound that is invisible or white under ambient conditions.

The concentration of the fluorescent compound within the aqueous carrier used to form the thermal papers of this invention can vary over wide limits. In general, an optical effect can be developed on most thermal papers with a fluorescent compound present which ranges from 2-20 wt % and preferably less than 10 wt %, based on the total weight of the solution, dispersion or emulsion of fluorescent compounds.

The methods of this invention provide thermal papers which have a fluorescent security mark printed over the thermosensitive coating. These methods comprise applying a solution, dispersion or emulsion of a fluorescent compound on the thermosensitive coating or on a conventional protective top coating positioned over the thermosensitive coating using conventional printing equipment and printing techniques at a temperature of less than 65° C.

Examples include those of relief printing, offset printing, flexography, lithography and silk-screening. Flexographic printing equipment is preferred, particularly where other indicia are printed on the thermal paper by flexographic printing.

To provide the solution, dispersion or emulsion of fluorescent compounds, the components are typically combined as dispersions at about 30 wt. % solids in a ball mill or similar conventional grinding equipment and agitated and ground.

The ink formulation can have a solids content which ranges widely such as from 2 to 30 wt. %, preferably less than 10 wt %, based on the total weight of the formulation. These solids primarily comprise the fluorescent compounds. For flexographic printing, a solids levels preferred for conventional flexographic printers, such as those provided by Wolverine and Mark Andy are suitable. The aqueous carrier used preferably dries by evaporation at a temperature below 50° C.

Conventional protective top coatings can optionally be deposited over the thermosensitive coating of the thermal papers of this invention prior to applying the security mark. Examples include acrylate coatings, varnishes, polyvinyl alcohol coatings, polyvinyl chloride coatings, styrenated layers and styrenated maleic anhydride layers as described in U.S. Pat. No. 5,843,864 and cellulose binders with a synthetic wax, as described in U.S. Pat. No. 4,740,495. Suitable UV cured protective top coatings are described in U.S. Pat. No. 4,886,744. U.S. Pat. No. 4,886,774 discloses the use of a UV cured coating comprising the reaction product of acrylated aromatic urethane oligomers as unsaturated oligomer, tetrahydrofural methacrylate, as methacrylate oligomer and trimethylolpropane triacrylate as crosslinking monomer. U.S. Pat. No. 5,158,924 also describes ultraviolet curing resins which are suitable for protective top coatings and include urethane resins, epoxy resins, organosiloxane resins, polyfunctional acrylate resins, melamine resins, thermoplastic resins having high softening points such as fluorine plastics, silicone resins, and polycarbonate resins. A specific example of a urethane acrylate-type UV curing resin is UNIDIC C7-157 made by Dainippon Ink & Chemicals Incorporated.

Conventional back coatings, as described in U.S. Pat. Nos. 6,060,426; 6,106,910; and 6,165,637, may optionally be applied.

Devices which irradiate the fluorescent compounds with ultraviolet radiation include incandescent light sources and other light sources which emit radiation at wavelengths in the range of 200-400 nm. Preferred light sources are those which have a maximum signal at the wavelength of the maximum absorbency of the fluorescent compound. Filters may be used to restrict the wavelengths which irradiate the fluorescent compounds.

If desired, photon detectors may be used to detect the fluorescent compounds, i.e., the photons emitted by the fluorescent compounds when irradiated at wavelengths in the range of about 200 nm to 400 nm. These include photomultiplier tubes, solid state detectors, semiconductor based detectors and similar devices. Preferably, the response by the fluorescent compound is detectable by the naked human eye.

Without further elaboration, it is believed that one skilled in the art can, using the preceding description, utilize the present invention to its fullest extent. The entire disclosure of all applications, patents, publications, cited above and below, are herein incorporated by reference.

EXAMPLES

Thermal Paper

A mill roll of commercial thermal paper having a thermosensitive coating on only one side thereof, such as Kanzaki P-300 thermal paper or Appleton thermal fax paper, is used. Alternatively, a thermal paper is prepared starting with a conventional base coat (about 40% solids) comprising conventional components, e.g., clays/binders applied to a base sheet. A conventional thermosensitive coating comprising conventional ODB-II dye, bisphenol co-reactant, sensitizer and stabilizer components is applied over the base coating.

The ODB-II dye is ground for 2 hours separately from the bisphenol co-reactant and sensitizer in order to avoid premature reaction during the grinding process. The dye grind (38% solids) and bisphenol grind (41% solids) are typically aged for a minimum of 12 hours, then mixed together for a minimum of 0.5 hr. before use in the coat applicator on the base sheet.

Solution of Fluorescent Compound

The following solution of fluorescent compound is prepared within an attritor:

i) 5-10 wt. % fluorescein UV fluorescent compound, ii) 85-93 wt. % water, and iii) 2-5 wt % ammonium hydroxide.

The viscosity of the solution is within the range of 5 to 100 cps at 25° C. and most preferably 12-25 cps at 25° C. The pH is maintained between 7-8 by the addition of an alkaline ink extender.

Thermal Paper with Fluorescent Security Mark

The solution of fluorescent compound described above is printed on a thermal paper, such as those described above, in the image of the logo for the NCR Corporation. A conventional flexopress suitable for printing water based flexographic inks is used. Drying without heat is accomplished by evaporation by exposure to air at temperatures below that which will develop the thermal paper.

Print Test

After a fluorescent security mark is printed on the thermal papers described above, the thermal papers provide a suitable print density when used within conventional thermal printers.

Security Test

The fluorescent security mark printed on the thermal paper is tested for luminescence by illuminating the printed paper with U.V. light from a black light that emits wavelengths in the range of 200 nm to 400 nm to cause the fluorescent compounds to fluoresce and fully reveal the latent image of the NCR to the naked human eye.

The preceding examples can be repeated with similar success by substituting the generically or specifically described reactants and/or operating conditions of this invention for those used in the preceding examples.

From the foregoing description, one skilled in the art can easily ascertain the essential characteristics of this invention, and without departing from the spirit and scope thereof, can make various changes and modifications of the invention to adapt it to various usages and conditions.

What is claimed is:

1. A thermal paper comprising:

a base sheet with an optional base coating;

a thermosensitive coating positioned over the base sheet, said thermosensitive coating comprising color forming compounds, an optional protective top coating positioned over said thermosensitive coating and an optional backcoating positioned over the base sheet on the side opposite the thermosensitive coating;

said thermal paper having a solution, dispersion or emulsion for providing a fluorescent security mark printed on said thermosensitive coating or on said optional protective top coating without pre-acting the color forming compounds or disrupting the color forming reaction by said color forming compounds, wherein said solution, dispersion or emulsion comprises a fluorescent compound which responds to ultraviolet light at wavelengths in the range of 200 nm to 400 nm by producing light at wavelengths in the range of 500-600 nanometers, the fluorescent compound in an aqueous carrier comprising an ammonium compound which solution, dispersion or emulsion does not pre-react the color forming compounds or disrupt the color forming reaction by said color forming compounds, the ammonium compound is in an amount of less than 5 percent by weight based on a total weight of the aqueous carrier; and the density of the fluorescent compound within the fluorescent security mark is sufficient such that the response to ultraviolet light at wavelengths in the range of 200 nm to 400 nm can be sensed by a photon detector, without premature coloration of the thermosensitive coating or blocking of the color forming reaction within the thermosensitive coating, the fluorescent security mark is to be printed over thermosensitive coating and the optional backcoating by a printing process which does not require temperatures above 50 to 60 degrees Celsius.

2. A thermal paper as in claim 1 wherein the aqueous carrier which provides the fluorescent security mark comprises an ammonium compound, to provide a pH in the range of above 7.0 and less than 10.

3. A thermal paper as in claim 2 wherein the aqueous carrier which provides the fluorescent security mark comprises ammonium hydroxide or a quaternary ammonium compound.

4. A thermal paper as in claim 2 wherein the aqueous carrier also comprises a pH buffer which does not cloud the aqueous carrier.

5. A thermal paper as in claim 2 wherein the security mark is white or colored from an additional pigment or dye within the solution, dispersion or emulsion of the fluorescent compound in an aqueous carrier.

6. A thermal paper as in claim 1 which has said optional protective top coating positioned over said thermosensitive coating and the solution, dispersion or emulsion is printed on the optional protective top coating.

7. A thermal paper as in claim 1, wherein the fluorescent security mark is invisible to the naked human eye under illumination with a 60 watt incandescent light bulb but visible to the naked human eye when illuminated with a black light that emits wavelengths in the range of 200 nanometers to 400 nanometers.

8. A thermal paper as in claim 1, wherein the fluorescent security mark is transparent or white to the naked human eye and forms a pseudo watermark at a viewing angle of less than 90° from the plane or the surface for said thermal paper when under illumination with a 60 watt incandescent light bulb.

9. A thermal paper comprising a base sheet, a thermosensitive coating positioned on only one surface of said base sheet and a solution, dispersion or emulsion for providing a fluorescent security mark printed on the same side of the base sheet as said thermosensitive coating, wherein the solution, dispersion or emulsion contains at least one fluorescent compound that responds to radiation of wavelengths in the range of 200 nm to 400 nm and is free of binder in an aqueous carrier comprising an ammonium compound which solution, dispersion or emulsion does not pre-react said thermosensitive coating or disrupt the color forming reaction by said thermosensitive coating, the fluorescent compound produces light at wavelengths in the range of 500-600 nanometers, and the thermosensitive coating is to be printed by a printing process which does not require temperatures above 50 to 60 degrees Celsius.

10. A method of providing thermal paper with a fluorescent security mark, the thermal paper comprising a base sheet with an optional base coating, a thermosensitive coating positioned over the base sheet, said thermosensitive coating comprising color forming compounds, an optional protective top coating positioned over said thermosensitive coating, and an optional backcoating positioned over the base sheet on the side opposite the thermosensitive coating, the method comprising:

printing a solution, dispersion or emulsion for providing the fluorescent security mark on said thermosensitive coating or on said optional protective top coating without pre-reacting the color forming compounds or disrupting the color forming reaction by said color forming compounds, wherein said solution, dispersion or emulsion comprises a fluorescent compound which responds to ultraviolet light at wavelengths in the range of 200 nm to 400 nm by producing light at wavelengths in the range of 500 to 600 nanometers, the fluorescent compound in an aqueous carrier comprising an ammonium compound which solution, dispersion or emulsion does not pre-react the color forming compounds or disrupt the color forming reaction by said color forming compounds, the ammonium compound 5 weight percent or less based on a total weight of the aqueous carrier and the fluorescent security mark is to be printed over the thermosensitive coating and the optional backcoating at temperatures that do not exceed 50 to 60 degrees Celsius, and wherein the density of the fluorescent compound within the fluorescent security mark is sufficient such that the response to ultraviolet light at wavelengths in the range of 200 nm to 400 nm can be sensed by a photon detector, without premature coloration of the thermosensitive coating or blocking of the color forming reaction within the thermosensitive coating.

11. A method of preparing thermal paper, the thermal paper comprising a base sheet and a thermosensitive coating positioned on only one surface of said base sheet, the method comprising:

printing a solution, dispersion or emulsion for providing a fluorescent security mark on the same side of the base sheet as said thermosensitive coating, wherein the solution, dispersion or emulsion contains at least one fluorescent compound that responds to radiation of wavelengths in the range of 200 nm to 400 nm by producing light at wavelengths in the range of 500 to 600 nanometers, the fluorescent compound is free of binder in an aqueous carrier comprising an ammonium compound which solution, dispersion or emulsion does not prereact said thermosensitive coating or disrupt the color forming reaction by said thermosensitive coating, the ammonium compound 5 weight percent or less based on a total weight of the aqueous carrier and the fluorescent security mark is to be printed over the thermosensitive coating at temperatures that do not exceed 50 to 60 degrees Celsius.

* * * * *

UNITED STATES PATENT AND TRADEMARK OFFICE

CERTIFICATE OF CORRECTION

PATENT NO. : 7,645,719 B2
APPLICATION NO. : 10/964047
DATED : January 12, 2010
INVENTOR(S) : Wehr et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 358 days.

Signed and Sealed this

Twenty-eighth Day of December, 2010

David J. Kappos

David J. Kappos
*Director of the United States Patent and Trademark Office*